US007855361B2

(12) United States Patent
Steiner

(10) Patent No.: US 7,855,361 B2
(45) Date of Patent: Dec. 21, 2010

(54) DETECTION OF POSITIVE AND NEGATIVE IONS

(75) Inventor: Urs Steiner, Sunnyvale, CA (US)

(73) Assignee: Varian, Inc., Santa Clara, CA (US)

( * ) Notice: Subject to any disclaimer, the term of this patent is extended or adjusted under 35 U.S.C. 154(b) by 164 days.

(21) Appl. No.: 12/130,198

(22) Filed: May 30, 2008

(65) Prior Publication Data

US 2009/0294654 A1 Dec. 3, 2009

(51) Int. Cl.
*H01J 49/28* (2006.01)
*H01J 49/00* (2006.01)

(52) U.S. Cl. ..... 250/292; 250/281; 250/282; 250/283; 250/287; 250/288; 250/298; 250/299; 250/397; 250/398; 250/424; 250/492.1; 315/506; 850/43

(58) Field of Classification Search ..... None
See application file for complete search history.

(56) References Cited

U.S. PATENT DOCUMENTS

| | | | | | |
|---|---|---|---|---|---|
| 3,562,142 | A * | 2/1971 | Lamont, Jr. | ..... | 204/298.06 |
| 4,066,894 | A * | 1/1978 | Hunt et al. | ..... | 250/292 |
| 4,090,075 | A | 5/1978 | Brinkmann | ..... | 250/282 |
| 4,136,280 | A | 1/1979 | Hunt et al. | | |
| 4,189,640 | A | 2/1980 | Dawson | ..... | 250/290 |
| 4,267,448 | A | 5/1981 | Feser et al. | ..... | 250/281 |
| 4,328,420 | A | 5/1982 | French | ..... | 250/282 |
| 4,423,324 | A * | 12/1983 | Stafford | ..... | 250/281 |
| 4,721,854 | A | 1/1988 | Dawson | ..... | 250/290 |
| 4,766,312 | A | 8/1988 | Fergusson et al. | ..... | 250/281 |
| 4,810,882 | A * | 3/1989 | Bateman | ..... | 250/281 |
| RE33,344 | E * | 9/1990 | Stafford | ..... | 250/281 |
| 4,963,736 | A | 10/1990 | Douglas et al. | ..... | 250/292 |
| 4,988,867 | A * | 1/1991 | Laprade | ..... | 250/281 |
| 5,026,987 | A | 6/1991 | Bier et al. | ..... | 250/281 |
| 5,202,561 | A * | 4/1993 | Giessmann et al. | ..... | 250/281 |
| 5,401,965 | A * | 3/1995 | Kaneko et al. | ..... | 850/43 |
| 6,075,244 | A * | 6/2000 | Baba et al. | ..... | 250/292 |
| 6,114,691 | A * | 9/2000 | Cousins | ..... | 250/282 |
| 6,737,641 | B2 * | 5/2004 | Kato | ..... | 250/281 |
| 6,979,818 | B2 * | 12/2005 | Scheidemann et al. | ..... | 250/299 |
| 7,084,393 | B2 * | 8/2006 | Fuhrer et al. | ..... | 250/283 |

(Continued)

FOREIGN PATENT DOCUMENTS

JP 09-264858 A 10/1997

(Continued)

*Primary Examiner*—David A Vanore
(74) *Attorney, Agent, or Firm*—Bella Fishman

(57) ABSTRACT

An ion detector comprises an ion guide with electrodes arranged about a first axis; a positive ion detection device with an ion inlet at a first side of the ion output section offset from and at an angle to the first axis; and a negative ion detection device with an ion inlet at a second side opposite the first side, offset from and at an angle to the first axis. A negative voltage bias applied to the positive ion device accelerates positive ions toward the inlet along a path including a component along a second axis orthogonal to the first axis. A positive voltage bias applied to the negative ion detection device accelerates negative ions toward the inlet along a path that includes a component along the second axis orthogonal to the first axis in a direction generally opposite to the path of the positive ions.

20 Claims, 12 Drawing Sheets

U.S. PATENT DOCUMENTS

| | | | | |
|---|---|---|---|---|
| 7,365,340 | B2 * | 4/2008 | Purser et al. | 250/424 |
| 7,394,073 | B2 * | 7/2008 | Cummings et al. | 250/397 |
| 7,427,751 | B2 * | 9/2008 | Geist et al. | 250/298 |
| 7,459,677 | B2 * | 12/2008 | Geist et al. | 250/288 |
| 2007/0187592 | A1 * | 8/2007 | Geist et al. | 250/298 |
| 2008/0073550 | A1 * | 3/2008 | Gupta et al. | 250/398 |
| 2008/0105833 | A1 * | 5/2008 | England et al. | 250/492.21 |
| 2008/0156981 | A1 * | 7/2008 | Miller et al. | 250/287 |
| 2009/0072163 | A1 * | 3/2009 | Lubicki et al. | 250/492.21 |
| 2009/0085504 | A1 * | 4/2009 | Lubicki et al. | 315/506 |
| 2009/0294643 | A1 * | 12/2009 | Steiner | 250/282 |
| 2009/0294654 | A1 * | 12/2009 | Steiner | 250/283 |
| 2010/0019141 | A1 * | 1/2010 | Olson et al. | 250/282 |

FOREIGN PATENT DOCUMENTS

| | | | |
|---|---|---|---|
| WO | WO 2008-042949 | A2 | 4/2008 |

* cited by examiner

DETECTION OF POSITIVE AND NEGATIVE IONS

FIELD OF THE INVENTION

The present invention relates generally to the detection of ions which finds use, for example, in fields of analytical chemistry such as mass spectrometry. More particularly, the present invention relates to selectively detecting positive or negative ions, including sequentially or simultaneously as desired.

BACKGROUND OF THE INVENTION

An ion detector is a type of transducer that converts ion current (ion flux, ion beam, etc.) to electrical current and thus is useful in technologies entailing the processing, transport, or manipulation of ions, such as for example mass spectrometry (MS), electronics fabrication, coating or surface treatment of articles of manufacture, etc. An ion detector is commonly employed in an MS system. Generally, an MS system converts the ionizable components of a sample material into ions and resolves (sorts, separates, or "analyzes") the ions according to their mass-to-charge ratios, thereby producing an output of mass-discriminated ions that is transmitted to the ion detector. The information represented by the ion output received by the ion detector is thus encoded as electrical signals to enable data processing by analog and/or digital techniques. The MS system processes the resulting electrical current outputted from the ion detector as needed to produce a mass spectrum, which may entail processing/conditioning by a signal processor, storage in memory, and presentation by a readout/display means. Typically, a mass spectrum is a series of peaks indicative of the relative abundances of the detected ions as a function of mass-to-charge ratio. A trained analyst can then interpret the mass spectrum to obtain information regarding the sample material processed by the MS system.

A typical ion detector includes, as a first stage, an ion-to-electron conversion device. Ions from the mass analyzer or other type of ion source are focused toward the ion-to-electron conversion device by an appropriately applied acceleration (bias) voltage. The ion-to-electron conversion stage typically includes a surface that emits electrons in response to impingement by ions. The conversion efficiency is different for each ion mass and its energy state at the time of impact. The ion conversion stage may be followed by an electron multiplier stage. In this case, a voltage potential is impressed across the length of a containment structure of the electron multiplier. The electrical current resulting from the ion-to-electron conversion is amplified in the multiplier stage through multiplication of liberated electrons. The gain of this multiplication can be influenced by the applied voltage potential. An anode positioned at the end of the multiplier collects the multiplied flux of electrons and the resulting electrical output current is transmitted to subsequent processes. Hence, the output of an ion detector equipped with an electron multiplier is an amplified electrical current proportional to the intensity of the ion current fed to the ion detector, the ion-to-electron conversion rate, and the gain of the electron multiplier. The entrance into the electron multiplier may be biased at a fixed acceleration voltage to draw ions into the electron multiplier, as is the case of the 3×0 triple quadrapole systems available from Varian, Inc., Palo Alto, Calif. As an example, the acceleration voltage at the input of the ion detector may be ±5 kV depending on the polarity of the ions to be detected, and the gain on the signal multiplier may range up to 2 kV.

This results in the output of the ion detector ranging from 3-7 kV. The output current from the ion detector can be processed as needed to yield a mass spectrum that can be displayed or printed by the readout/display means as noted above. Typically, the output current is converted to a voltage signal, digitized, and then transmitted to ground-based circuitry for further processing.

Many ion detectors are capable of detecting ions of only one polarity, that is, either positive ions or negative ions. Some ion detectors, however, have been designed to detect both positive and negative ions. Typically, the entrance into the signal multiplier is aligned on-axis with the incoming ion beam, which is disadvantageous in that neutral (uncharged) particles of no analytical value enter the ion detector and contribute to problems such as varying signal noise, reduced sensitivity, fouling, etc. Moreover, to be able to detect either positive ions or negative ions, the ion detector requires electronics that enable to polarity of the acceleration voltage to be switched. This switching requires a large voltage swing on which the gain voltage and the operating voltage of the detector's electronics ride on top. Consequently, the maximum switching speed is limited (typically 200-2000 ms) and the fast-switching circuitry required is complex and costly.

In one example of an ion detector capable of detecting either positive and negative ions, U.S. Pat. No. 4,267,448, discloses an electron multiplier inherently designed to detect positive ions. The first dynode that leads into the electron multiplier is continuously biased at −2 kV. A shutter-type acceleration electrode is positioned in front of the first dynode and can be selectively biased at either a positive or negative voltage. To detect negative ions, the acceleration electrode is biased at a positive voltage and hence operates as a conversion dynode. Negative ions impact the acceleration electrode, are converted to positive ions, and then are accelerated to the first dynode under the influence of its negative voltage bias. To detect positive ions, a high-voltage power supply connected to the acceleration electrode must be switched to a negative voltage. Another example, U.S. Pat. No. Re 33,344, similarly provides a conversion dynode in front of an electron multiplier to convert incoming negative ions to positive ions. Ion detectors such as disclosed in U.S. Pat. Nos. 4,627,448 and Re 33,344 suffer from the disadvantages noted above in that they require complex and costly switching hardware and switching between polarities causes undesirable delay. Additionally, these types of ion detectors do not adequately prevent neutral particles from entering the ion detector.

Some ion detectors have been designed to detect both positive and negative ions simultaneously. In one example, U.S. Pat. No. Re 33,344 also discloses a positively-biased conversion dynode and a negatively-biased first-stage dynode in front of a single, continuous-dynode electron multiplier. A plate is in turn positioned in front of the conversion dynode and the first-stage dynode. One aperture of the plate is aligned with the conversion dynode and another aperture of the plate is aligned with the first-stage dynode. Negative ions are attracted through the first aperture of the plate to the conversion dynode where they are converted to positive ions and subsequently flow into the electron multiplier. Positive ions are attracted through the second aperture of the plate to the first-stage dynode and subsequently flow into the remaining portion of the electron multiplier. In another example, U.S. Pat. No. 4,066,894 discloses the use of two separate ion detectors with two respective electron multipliers. The electron multipliers are arranged adjacent to each other, both in the direction of the axis of incoming ions. One ion detector is configured to detect positive ions and the other ion detector is configured to detect negative ions. Ion detectors such as disclosed in U.S. Pat. Nos. Re 33,344 and 4,066,894 also suffer from the disadvantages noted above in that they do not adequately prevent neutral particles from entering the ion detector. Moreover, they do not adequately ensure that an acceptable number of ions of a given polarity strike the corresponding first dynode and are detected.

In another example, U.S. Pat. No. 4,810,882 discloses utilizing a negatively-biased conversion electrode positioned off-axis on one side of the incoming ion flight path and a positively-biased transmission/conversion electrode positioned off-axis on the opposite side of the ion flight path. A single photomultiplier with an electron-to-photon conversion electrode is located downstream of the transmission/conversion electrode. Positive ions are deflected off-axis and strike the conversion electrode, thus releasing secondary electrons. Negative ions are deflected off-axis and strike the transmission/conversion electrode, thus releasing secondary electrons. In both cases, the secondary electrons are accelerated in the same direction through the transmission/conversion electrode toward the electron-to-photon conversion electrode of the photomultiplier. This type of ion detector is disadvantageous in that, like the other ion detectors mentioned above, the ion detector requires at least one conversion dynode. Conversion dynodes require high acceleration voltages, are prone to producing a corona discharge, and contribute to background signal noise.

Accordingly, there continues to be a need for improved ion detectors capable of detecting positive and negative ions.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an ion detector for selectively detecting positive and negative ions includes an ion guide, a positive ion detection device, and a negative ion detection device. The ion guide includes a plurality of electrodes arranged about a first axis and configured to apply an RF field to constrain ions to motions generally about the first axis. The positive ion detection device includes a positive ion inlet disposed at a first side of the ion output section, the positive ion inlet being offset from and at an angle to the first axis. The positive ion detection device is configured to apply a negative voltage bias and accelerate positive ions along a positive ion path directed from the ion guide into the positive ion inlet. The positive ion path includes a component directed along a second axis orthogonal to the first axis. The negative ion detection device includes a negative ion inlet disposed at a second side of the ion output section opposite the first side, the negative ion inlet being offset from and at an angle to the first axis. The ion detection device is configured to apply a positive voltage bias and accelerate negative ions along a negative ion path directed from the ion guide into the negative ion inlet. The negative ion path includes a component directed along the second axis generally opposite to the component of the positive ion path.

According to another implementation, a method is provided for selectively detecting positive and negative ions. A plurality of particles is guided in an ion guide generally along a first axis by applying an RF voltage to a plurality of electrodes of the ion guide to generate an RF field in the ion guide and constrain ions of the plurality of particles to motions focused along the first axis. A first ion detector is negatively biased and any positive ions of the plurality of particles are accelerated to flow along a positive ion path from the ion guide toward the first ion detector, the positive ion path including a component directed along a second axis orthogonal to the first axis. A second ion detector is positively biased and any negative ions of the plurality of particles are accelerated to flow along a negative ion path from the ion guide into the second ion detector, the negative ion path including a component directed along the second axis generally opposite to the component of the positive ion path.

According to various implementations of the method, either or both ion detectors may be selectively operated simultaneously or sequentially to detect positive and/or negative ions simultaneously or sequentially.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The subject matter disclosed herein generally relates to the detection of ions and associated ion processing. Examples of implementations of methods and related devices, apparatus, and/or systems are described in more detail below with reference to FIGS. 1-5. These examples are described in the context of mass spectrometry (MS). However, any process that involves the detection of ions may fall within the scope of this disclosure. Additional examples include, but are not limited to, vacuum deposition and other fabrication processes such as may be employed to manufacture materials, electronic devices, optical devices, and articles of manufacture.

Figure 1:
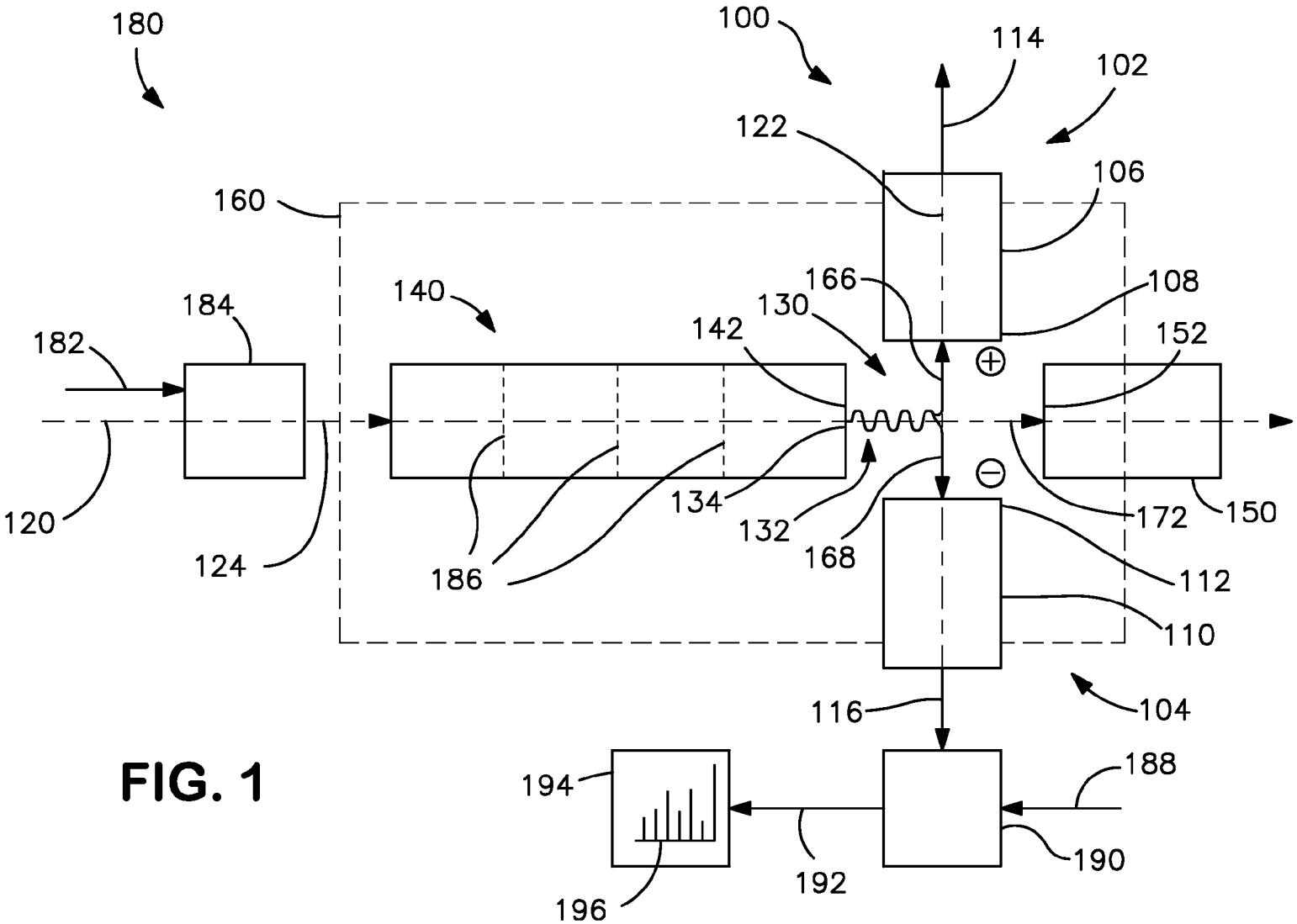
FIG. 1 is a schematic view of an example of an ion detector and an example of a system in which the ion detector may operate.

FIG. 1 is a schematic view of an example of an ion detector (or ion detection apparatus, assembly, or system) 100 according to an implementation of the present disclosure. The ion detector 100 includes a first ion detection device or unit 102 and a second ion detection device or unit 104. One of the ion detection devices 102 or 104 is configured to detect ions of one polarity (positive or negative) and the other ion detection device 104 or 102 is configured to detect ions of the opposite polarity (negative or positive). In the illustrated example, the first ion detection device 102 is a positive ion detection device and the second ion detection device 104 is a negative ion detection device. The positive ion detection device 102 generally includes a housing 106 and a positive ion inlet 108. The negative ion detection device 104 likewise generally includes a housing 110 and a negative ion inlet 112. Each housing 106 and 110 includes components and circuitry as needed to convert ions received at the respective positive ion inlet 108 and negative ion inlet 112 into electrical currents indicative of ion intensity as appreciated by persons skilled in the art. FIG. 1 illustrates a detector output current 114 produced by the positive ion detection device 102 and a detector output current 116 produced by the negative ion detection device 104. The positive ion detection device 102 includes a voltage source (not shown) for negatively biasing the positive ion inlet 108 to accelerate or attract positive ions to flow into the positive ion inlet 108. The negative ion detection device 104 likewise includes a voltage source (not shown) for positively biasing the negative ion inlet 112 to accelerate or attract negative ions to flow into the negative ion inlet 112. The positive ion inlet 108 may be biased at a voltage falling within any suitable range of negative voltage values for attracting positive ions, and the negative ion inlet 112 may be biased at a voltage falling within any suitable range of positive voltage values for attracting negative ions. In one non-limiting example, the positive ion inlet 108 may be biased at a voltage of −5 kV or thereabouts and the negative ion inlet 112 may be biased at a voltage +5 kV or thereabouts. In a typical implementation, these biasing voltages are fixed during operation. Each ion detection device 102 and 104 may also include a signal multiplier such as an electron multiplier for multiplying electrons as needed to produce an amplified electrical detector output current 114 or 116 representative of detected ion intensity. When provided with a signal multiplier, the electronics in each ion detection device 102 and 104 include circuitry for applying a gain voltage across the signal multiplier to control the multiplication factor as appreciated by persons skilled in the art.

FIG. 1 illustrates both the positive ion detection device 102 and the negative ion detection device 104 installed in the ion detector 100. In other implementations, only one of the ion detection devices 102 or 104 may be installed. That is, the ion detector 100 may be configured to detect positive ions only, negative ions only, or both positive and negative ions.

For illustrative purposes, FIG. 1 shows two references axes, a first axis 120 and a second axis 122, which by example may be referred to as a z-axis and a y-axis respectively. FIG. 1 illustrates a flow of particles 124 directed generally along the first axis 120. The particle flow 124 may include a flow of positive and/or negative ions (e.g., an ion beam) as well as neutral particles (e.g., gas molecules, liquid droplets, etc.). The ion detector 100 further includes an output (or ion diverting) section or region 130 through which the first axis 120 runs. As described below and illustrated in FIG. 2, the ion detector 100 may include a detector ion guide located in the output section 130. The detector ion guide includes means for trapping or focusing ions in the output section 130 whereby the motions of the ions are constrained to an ion field 132 concentrated generally along the first axis 120. The positive ion detection device 102 and the negative ion detection device 104 are spaced at a distance from each other on opposite sides of the output section 130 relative to the second axis 122. At least the positive ion inlet 108 of the positive ion detection device 102 and the negative ion inlet 112 of the negative ion detection device 104 are each arranged in an offset or transverse, angled relation to the first axis 120. In the illustrated example, the positive ion inlet 108 and the negative ion inlet 112 are each arranged about the second axis 122. Hence, the positive ion inlet 108 and the negative ion inlet 112 are disposed orthogonal to the first axis 120 and orthogonal to the particle flow at least at a location 134 where the particle flow enters the output region 130. As used herein, the term "orthogonal" is taken to encompass "substantially orthogonal" to account for implementations in which the positive ion inlet 108 and the negative ion inlet 112 are not oriented exactly 90 degrees relative to the first axis 120.

As also illustrated in FIG. 1, an upstream ion processing device 140 may be located at an input side of the output section 130. All or part of the upstream ion processing device 140 may be arranged about the first axis 120. In particular, an axial outlet 142 of the upstream ion processing device 140 is located at (directly on or near) the first axis 120 such that a particle outlet flow 132 is emitted from the outlet 142 and into the output section 130 generally along the first axis 120. While the upstream ion processing device 140 and the first axis 120 are illustrated as being straight or linear, it will be understood that all or part of the upstream ion processing device 140 may be curvilinear or include straight sections that are angled or orthogonal to the illustrated horizontal first axis 120. That is, when the first axis 120 is considered as corresponding to the particle flow through the upstream ion processing device 140, it will be understood that this part of the first axis 120 may likewise be straight or linear, curvilinear, or include straight sections that are angled or orthogonal to the illustrated horizontal first axis 120. An example of a 180-degree curved arrangement is disclosed in U.S. Pat. No. 6,576,897, assigned to the assignee of the present disclosure. In some implementations, all or part of the upstream ion processing device 140 or at least its outlet 142 may be considered as being part of the ion detector 100.

In addition to the upstream ion processing device 140, a downstream ion processing device 150 may be located at an axial output side of the output section 130. All or part of the downstream ion processing device 150 may be arranged about the first axis 120 and like the upstream ion processing device 140 may be linear, curved, or have sections oriented in differing directions. An axial inlet 152 of the downstream ion processing device 150 may be located at (directly on or near) the first axis 120 such that a particle flow is emitted from the output section 130 and into the inlet 152 generally along the first axis 120. In some implementations, all or part of the downstream ion processing device 150 or at least its inlet 152 may be considered as being part of the ion detector 100. Examples of ion processing devices 140 and 150 are described below.

All or part of the ion detection devices 102 and 104 (particularly the positive ion inlet 108 and the negative ion inlet 112) and all or part of the upstream ion processing device 140 (if provided) and the downstream ion processing device 150 (if provided) may be enclosed in a suitable housing or structural enclosure 160. Depending on the type of MS system or other ion processing system contemplated, the enclosure may provide an evacuated, low-pressure, or ambient pressure environment. The output region 130, being located between the ion detection devices 102 and 104, is also enclosed in the enclosure 160. Accordingly, the output region 130 may be considered as structurally defined at least in part by the volume between the positive ion inlet 108 and the negative ion inlet 112, with the enclosure of the output region 130 being completed by the schematically illustrated enclosure 160.

In operation, the particle outlet flow 134, which may be provided from an upstream device or ion source 140 as noted elsewhere in this disclosure, enters the output section 130 generally along the first axis 120. The particle outlet flow 134 may include positive ions, negative ions and/or neutral particles. The detector ion guide in the output section 130 is operated to focus the ions along the first axis 120 as generally depicted by the focused ion beam 132. If the positive ion detection device 102 is installed and activated, then any positive ions in the particle flow 132 are accelerated toward the positive ion inlet 108 under the influence of the negative bias voltage applied to the positive ion inlet 108. The positive ion detection device 102 converts received positive ions into electrical current and outputs this signal over the detector output line 114. If the negative ion detection device 104 is installed and activated, then any negative ions in the particle outlet flow 132 are accelerated toward the negative ion inlet 112 under the influence of the positive bias voltage applied to the negative ion inlet 112. The negative ion detection device 104 converts received negative ions into electrical current and outputs this signal over the detector output line 116. Signals over the detector output lines 114 and/or 116 are then processed as desired to derive useful information regarding the positive and/or negative ions detected.

Due to the off-axis orientation of the positive ion detection device 102, positive ions of the ion beam 132 are diverted from the first axis 120 and follow a positive ion path generally depicted by way of example by an arrow 166 in FIG. 1. Similarly, due to the off-axis orientation of the negative ion detection device 104, negative ions of the ion beam 132 are diverted from the first axis 120 and follow a negative ion path generally depicted by way of example by another arrow 168 in FIG. 1 generally having an orientation opposite to that of the positive ion path 166. Here, the schematic nature of FIG. 1 should be emphasized, as no specific limitation is intended for the precise trajectories of the positive ion path 166 and the negative ion path 168. Generally, the positive ion path 166 deviates from the first axis 120, runs to a surface of the positive ion inlet 108, and includes a component in a direction of the second axis 122 orthogonal to the first axis 120. Similarly, the negative ion path 168 deviates from the first axis 120, runs to a surface of the negative ion inlet 112, and includes a component in the direction of the second axis 122 opposite to the direction of the second-axis component of the positive ion path 166. The trajectory of each ion path 166 and 168 may range from being somewhat linear but angled relative to the first axis 120 and second axis 122, or curved according to some radius of curvature (which may vary along the ion path 166 or 168), or substantially orthogonal to the first axis 120 in the nature of a 90-degree turn relative to the first axis 120, or may include a combination of two or more of the foregoing types of trajectories. The precise shape of each ion path 166 and 168 and the point along the first axis 120 at which the ion path 166 or 168 begins to diverge from the first axis 120 may depend on a variety of factors, such as, for example, the mass-to-charge ratio of the ions, the strength of the voltage bias, the time at which the voltage bias is applied relative to the time at which the ions enter the output section 130, whether both ion detection devices 102 and 104 are operating such that both the positive and negative voltage biases may affect the motion of positive and negative ions, the shape of the surface(s) associated with the ion inlets 108 and 112, the positions of the ion inlets 108 and 112 relative to the first axis 120 or to the second axis 122, the presence or absence of an ion focusing or trapping field in the output section 130 and the operating parameters (voltage amplitude, frequency, RF-only or RF/DC) of that field, etc.

The arrangement of opposing dual ion detection devices 102 and 104 orthogonal or substantially orthogonal to the first axis 120 may provide a number of advantages, including the following. First, the use of two separate ion detection devices 102 and 104 for individual ion polarities eliminates the complexity and cost of components and circuitry conventionally required when employing a single detection unit to detect either positive or negative ions. Examples of such complexity and/or cost include the electronics associated with switching the polarity of the acceleration (bias) voltage, the large voltage swings involved with switching, the delay occurring with such switching, and the need for fast switching circuitry to minimize the delay. Second, only one type (positive or negative) of ion detection device 102 or 104 needs to be installed if desired, thus offering a low-cost ion detection solution that requires only one +5 kV or −5 kV power supply. Third, the arrangement eliminates the need for providing the ion detector 100 with conversion dynodes that convert the polarity of an impinging ion to the opposite polarity. Elimination of conversion dynodes allows for lower acceleration voltages, thereby reducing background noise and the risk of a corona discharge. Fourth, the arrangement is able to detect small negative ions very efficiently, which conventionally has been difficult to do. Fifth, uncharged (neutral) particles flowing through the output section 130 are unaffected by the off-axis ion detection devices 102 and 104, even when only one of the ion detection devices 102 or 104 is installed or being utilized. Because the ion detection devices 102 and 104 are offset by a distance and an angle from the first axis 120, the flow of uncharged particles is completely unimpeded. Uncharged particles continue to fly straight through the output section 130 generally along the first axis 120 as generally depicted by an arrow 172, and thus do not produce any signal, thereby eliminating or at least significantly reducing noise attributed to uncharged particles.

Sixth, if the power supply to the ion detection devices 102 and 104 is turned off, the detector ion guide in the output section 130 can still be operated to focus the ions. The detector ion guide facilitates passing these ions to the downstream ion processing device 150, which may be another MS system.

Seventh, due to the provision and orientation of the two ion detection devices 102 and 104, the operation of both ion detection devices 102 and 104 simultaneously can be utilized to facilitate the detection of either positive or negative ions. This is because while one ion detection device 102 or 104 may function to attract ions of a given polarity the other ion detection device 104 or 102 may function to repel the same ions. Positive ions may be accelerated toward the positive ion inlet 108 of the positive ion detection device 102 under the "pulling" influence of the negative bias voltage applied to the positive ion inlet 108 and, additionally, under the "pushing" influence of the positive bias voltage applied to the negative ion inlet 112 of the negative ion detection device 104. Likewise, negative ions may be accelerated toward the negative ion inlet 112 of the negative ion detection device 104 under the "pulling" influence of the positive bias voltage applied to the negative ion inlet 112 and, additionally, under the "pushing" influence of the negative bias voltage applied to the positive ion inlet 108 of the positive ion detection device 102.

Eighth, the arrangement enables a variety of different operational modes for the ion detector 100. For instance, the particle flow may include both positive and negative ions. The ion detector 100 may be operated to detect positive ions only, negative ions only, both positive and negative ions simultaneously, or positive and negative ions sequentially. In another example, depending upon the configuration and operation of the upstream ion processing device 140, which may include a combination of two or more different types of ion processing devices, the particle flow may consist of time-sequenced groups or packets of positive and/or negative ions. The two ion detection devices 102 and 104 may be operated simultaneously or sequentially to detect ions of a selected polarity from each incoming packet.

As previously noted, the detection ion guide in the output section 130 between the two ion detection devices 102 and 104 may be configured to generate a two-dimensional RF ion trapping or focusing field that imparts a restoring force on the ions toward the first axis 120. The focusing field may be utilized for a variety of purposes, including controlling ion paths prior to detection or downstream processing. In the case of ion detection, the biasing voltage of the ion detection device 102 or 104 must be strong enough to impart enough energy to ions of a given polarity to enable those ions to overcome the restoring force of the RF field.

FIG. 1 also illustrates an example of an ion processing system 180 in which the ion detector 100 may be implemented if desired. The ion processing system 180 may, for example, be a mass spectrometry (MS) system (or apparatus, device, etc.) configured to perform a desired MS technique (e.g., single-stage MS, tandem MS or MS/MS, $MS^n$, etc.). The ion processing system 180 may include a sample introduction device, which in FIG. 1 is schematically depicted as a sample input line 182, and an ion source or ionization device 184. The sample introduction device 182 introduces a sample material to be ionized into the ion source 184. In "hyphenated" techniques, the sample input line 182 may be the output of an analytical separation instrument such as employed for chromatography, electrophoresis, solid-phase extraction, or other techniques. The ion source 184 is then operated to ionize the sample according to any ionization technique and may be configured to produce an output particle stream 124 of positive and/or negative ions as well as neutral species. The particle flow 124 resulting from the ion source 184 may be transmitted directly into the output region 130 of the ion detector 100, in which case the depicted particle stream portions 124 and 132 may be one and the same and the particle exit of the ion source 184 corresponds to the outlet 142 leading into the output section 130 of the ion detector 100. Alternatively, the particle stream 124 may first be directed into the afore-mentioned upstream ion processing device 140.

The illustrated upstream ion processing device 140 may represent a single type of ion processing device configured to perform one or a few primary ion processing functions such as mass filtering, ion guiding or focusing, etc. Alternatively, the illustrated upstream ion processing device 140 may represent a combination of different types of ion processing modules configured to perform a variety of ion processing operations, as indicated schematically by partition lines 186 in FIG. 1. Examples of ion processing devices or modules include, but are not limited to, an ionizing device (in a case where the external atmospheric-pressure ionization device 184 is not employed), an ion storage or trapping device including the type applying an RF (or RF/DC) trapping field, a mass-sorting or mass-analyzing device for mass-discrimination of ions, an ion fragmenting device such as a collision cell or ion trap, ion optics such as one or more grids, lenses or apertured plates, etc.

The illustrated downstream ion processing device 150 may likewise represent a single type of ion processing device or a combination of different types of ion processing modules. Examples of ion processing devices or modules include, but are not limited to, a particle collection device, an ion storage or trapping device including the type applying an RF (or RF/DC) trapping field, a mass-sorting or mass-analyzing device for mass-discrimination of ions, an ion fragmenting device such as a collision cell or ion trap, ion optics such as one or more grids, lenses or apertured plates, a vent to an ambient environment, etc.

In an example of tandem MS that utilizes both an upstream ion processing device 140 and a downstream ion processing device 150, the upstream ion processing device 140 may perform mass analyzing operations on precursor (parent) ions. The downstream ion processing device 150 may then perform fragmentation of precursor ions to produce product (daughter) ions and then mass-analyze the product ions. In this regard, it will be appreciated that the ion processing system 180 may include another ion detector downstream of the downstream ion processing device 150, which may structured similarly to the illustrated ion detector 100. More generally, the ion processing system 180 may include any number of ion detectors 100 and ion processing devices 140 or 150. It will also be understood that the ion detector 100 need not include any downstream ion processing device 150. Both undetected charged particles as well as neutral particles may simply flow through the output section 130 generally along the first axis 120 to an environment external to the ion detector 100.

The particle stream 124 resulting from operation of the ion source 184 or the particle stream resulting from operation of the upstream ion processing device 140 is flowed into the output section 130 of the ion detector 100 where the ions are focused as an ion beam 132 by the detector ion guide. As described above, one or both of the positive ion detection device 102 and negative ion detection device 104 are selectively operated to detect positive and/or negative ions as desired. To accomplish this, the ion detector 100 creates the off-axis positive ion path 166 and/or off-axis negative ion path 168 as described above. As a result, the positive ion detection device 102 produces a detector output signal that may be transmitted over lines 114 and 188 to a system controller 190, which in some implementations may be referred to as MS electronics. The negative ion detection device 104 likewise produces a detector output signal that may be transmitted over the line 116 to the system controller 190.

The system controller 190 may include, for example, signal processing and/or detector control devices or circuitry, a data acquisition device or circuitry, etc. The system controller 190 may include a main computer that includes a terminal, console or the like for enabling interface with an operator of the ion processing system 180, and/or one or more modules or units that have dedicated functions such as instrument control and data acquisition and processing. In addition to performing signal processing and conditioning and data acquisition, the system controller 190 may be configured to control the operations of the ion detector 100 such as, for example, the timing and application of the acceleration voltages at the positive ion inlet 108 and negative ion inlet 112, the monitoring of the ion signal received at the positive ion inlet 108 and negative ion inlet 112, the control and adjustment of gain voltages applied to respective signal multipliers of the ion detection devices 102 and 104, the application and control of an ion focusing field in the output section 130, etc. However, at least some of the foregoing ion detector control operations may be performed directly by electronics provided with the ion detection device 102 or 104 itself. In addition, the system controller 190 may represent an electronic controller configured to control the operations of other components of the ion processing system 180 such as, for example, the sample introduction system 182, the ion source 184, and the ion processing devices 140 and 150. The system controller 190 may transmit signals over a data line 192 to a readout or display device 194 configured to produce information 196 pertaining to the detected ions such as a mass spectrum.

Figure 2:
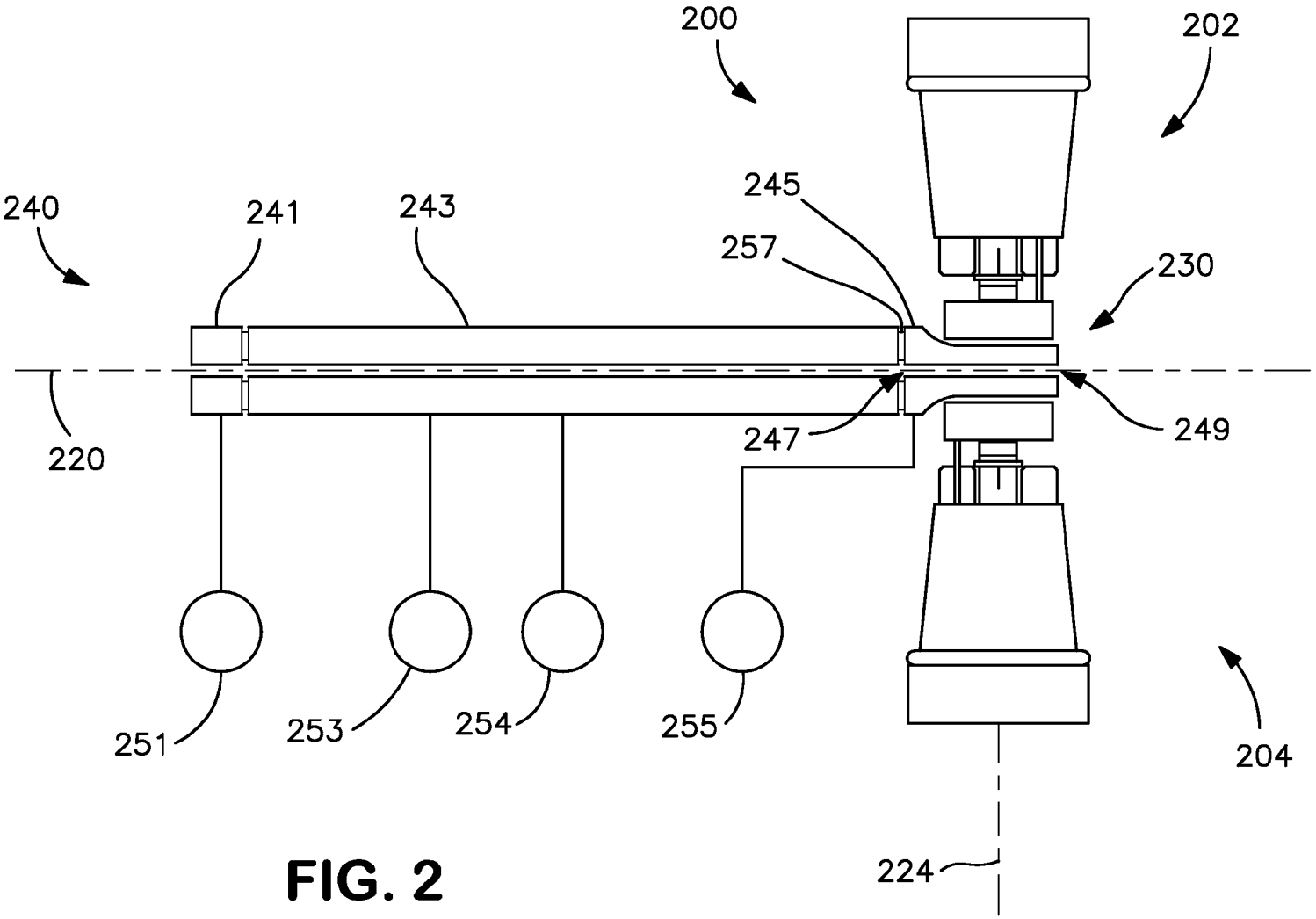
FIG. 2 is an elevation view of an example of an ion detector and an ion processing device supplying ions to the ion detector.

FIG. 2 illustrates an example of an ion detector 200 and an ion processing device 240 supplying ions to the ion detector 200. A mutually orthogonal first axis 220 and second axis 224 are again shown for reference purposes. The ion detector 200 includes a positive ion detection device 202 and a negative ion detection device 204 arranged on opposing sides of an output section 230 generally about the second axis 222 normal (or substantially normal) to the first axis 220 of incoming particle flow as described above. The ion processing device 240 in this example includes three multipole (e.g., quadrupole) sections: an RF-only pre-filter 241, a mass filter 243, and an RF-only detector ion guide 245. As appreciated by persons skilled in the art, such multipole sections include a plurality of electrodes (or rods) elongated along the first axis 220 of a main or resultant particle flow and spaced from each other about the first axis 220 (and usually all parallel to the first axis 220). The RF-only pre-filter 241 is configured to apply a controlled RF field between its electrodes to focus ions along the first axis 220 in preparation for mass filtering. The mass filter 243 is configured to apply a controlled RF field and typically also a DC field between its electrodes to separate ions based on mass-to-charge ratio in accordance with well-known principles. The detector ion guide 245 is configured to apply a controlled RF field between its electrodes to focus the ions received from the mass filter 243 along the first axis 220 in preparation for ion detection or further downstream processing (not shown). For these purposes, appropriate voltage sources are provided, as schematically depicted by an RF voltage source 251 communicating with the RF-only pre-filter 241, an RF voltage source 253 and a DC voltage source 254 communicating with the mass filter 243, and an RF voltage source 255 communicating with the detector ion guide 245. The electrodes of the detector ion guide 245 extend into the output section 230 of the ion detector 200. Thus, the output section 230 may generally be considered as including all or a portion of the detector ion guide 245, and an end 257 of the mass filter 243 leading into the detector ion guide 245 may generally be considered as the inlet into the output section 230. The detector ion guide 245 generally includes an axial inlet 247 communicating with the mass filter 243 for receiving ions and an axial outlet 249 communicating with an MS device or other downstream device or environment for discharging from the detector ion guide 245 neutral particles and ions not deflected by the ion detection devices 202 and 204.

The ion detector 200 includes means for switching the ion detector 200 between an ion detecting mode and a non-detecting mode. In the ion detecting mode, the ion detection devices 202 and/or 204 are active such that positive and/or negative ions are diverted along positive and/or negative ion paths for detection as described above. In the non-detecting mode, all species of the particle stream flow through the detector ion guide 245 generally along the first axis 220 and through its exit 249, without being deflected off-axis. The switching means may include the power supplies and associated circuitry (see FIG. 3 and description below) that apply the ion-accelerating voltage biases described above, and may be controlled by a suitable controller such as the system controller 190 schematically represented in FIG. 1.

Figure 3:
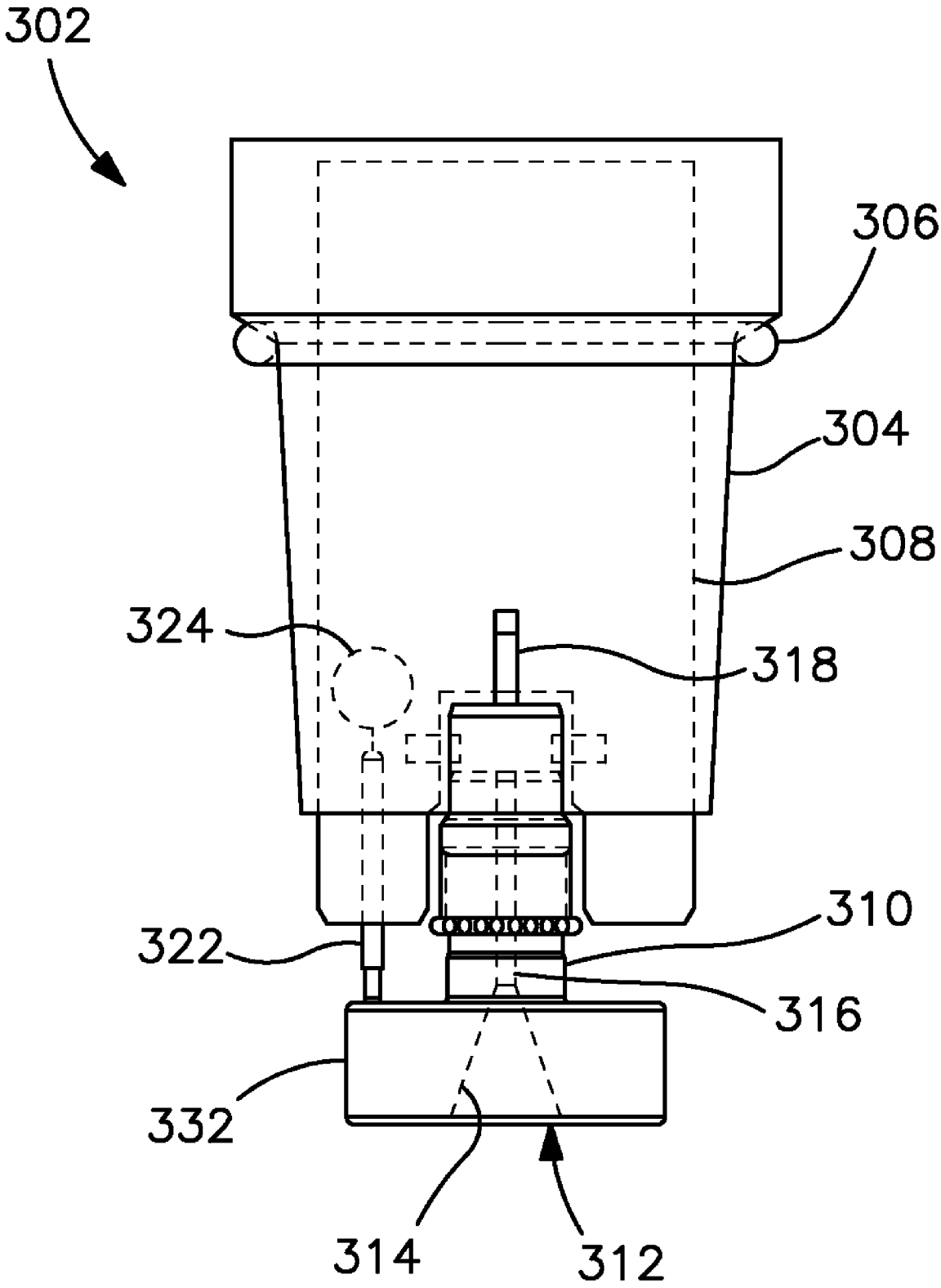
FIG. 3 is an elevation view of an example of an ion detection device configured to detect positive ions or negative ions.

FIG. 3 illustrates an example of an ion detection device 302. Two such ion detection devices 302 may be utilized as a positive ion detector and a negative ion detector in an off-axis ion detector as described above. The ion detection device 302 includes a housing or body 304, which may be constructed from a suitable electrically insulative material such as, for example, epoxy resin. An O-ring or gasket 306 may be provided on the housing 304 for creating a vacuum seal. The ion detection device 302 further includes an electronics board 308 protected within the housing 304. The ion detection device 302 further includes a signal multiplier, which in the present example is provided as an electron multiplier (EM) 310. The EM 310 may extend from the housing 304 to an ion inlet 312 of the ion detector 302. The EM 310 may include a tapered or funnel-shaped inlet section 314 that opens at the ion inlet 312 and transitions to a narrower-bore tube section 316, which in turn terminates at an anode 318 in signal communication with circuitry of the electronics board 308. The inner surface of the inlet section 314 of the EM 310 may be biased at an acceleration voltage of desired magnitude and polarity via a contact pin 322 communicating with a high-voltage power supply 324 (for example, +5 kV for a negative ion detector, −5 kV for a positive ion detector) provided with the electronics board 308. In this example, a grounded outer shield 332 surrounds the inlet section 314.

As appreciated by persons skilled in the art, the EM 310 converts the ion signal received at the ion inlet 312 into an electrical signal (current) indicative of and proportional to the intensity of the received ion signal, and amplifies the current signal pursuant to a controlled gain. Here, the intensity of the ion signal may be given in ion counts per second, and the resulting output electrical signal may be given in Coulombs per second (amperes, or A). The circuitry of the electronics board 308 may include an EM voltage driver such as a DC amplifier that provides a gain voltage across the length of the EM 310 and thereby determines the overall gain of the EM 310. In one example, the output (or gain) voltage of the EM voltage driver may be varied from about 600 V to about 2000 V. The circuitry of the electronics board 308 may include signal processing functionality for collecting data. In one example, the circuitry includes an electrometer (including, for example, a current-to-voltage amplifier) or other component configured to convert the current signal transmitted from the anode 318 to a voltage signal and an analog-to-digital converter to digitize the voltage signal. The circuitry may also include components for scaling and filtering the collected data in preparation for further processing. The circuitry may also include components for calibration and for controlling/adjusting/optimizing the gain on the EM 310. The circuitry may include an analog and/or digital controller for controlling the various operations and functions of the circuitry and other components of ion detection device 302.

Figure 4:
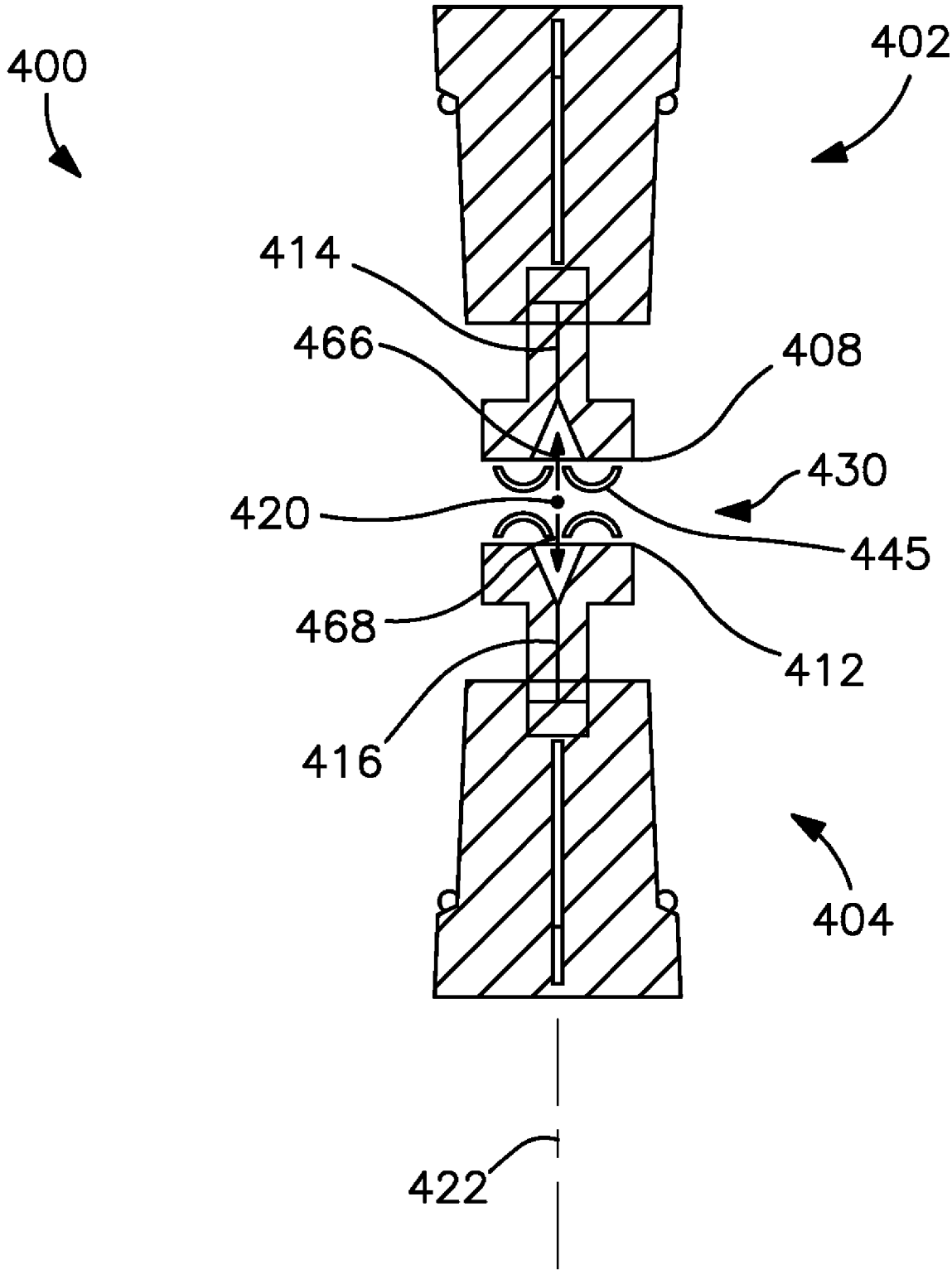
FIG. 4 is a cross-sectional elevation end view of an example of an ion detector.

FIG. 4 is a cross-sectional elevation end view, taken in a plane coincident with the second axis 224 shown in FIG. 2, of an example of an ion detector 400. A mutually orthogonal first axis 420 and second axis 422 are again shown for reference purposes. The ion detector 400 includes a positive ion detection device 402 and a negative ion detection device 404 arranged on opposing sides of an output section 430. The positive ion detection device 402 includes a positive ion inlet 408 and the negative ion detection device 404 includes a negative ion inlet 412. In this example, the positive ion inlet 408 and the negative ion inlet 412 are oriented about the second axis 422, i.e., the axis normal to the axis 420 of incoming particle flow. The ion detection devices 402 and 404 may include respective EMs 414 and 416 or other types of signal multipliers and may otherwise be configured as described above and illustrated in FIG. 3. A negative bias voltage applied to the positive ion inlet 408 establishes a positive ion path having a directional or vector component 466 along (or parallel to) the second axis 422. A positive bias voltage applied to the negative ion inlet 412 establishes a negative ion path having a directional or vector component 468 along (or parallel to) the second axis 422 in the direction opposite to the positive ion path. In this example, the output section 430 includes a set 445 of four electrodes configured to generate an RF-only ion trapping or focusing field, as described above in the context of an RF-only post-filter extending from an upstream ion processing device. The positive ion path runs between the two upper electrodes and the negative ion path runs between the two lower electrodes. In one implementation, each electrode of the electrode set 445 is semicircular in cross-sectional shape and may be either hollow as shown or solid. By this configuration, the electrode set 445 takes up less space in the outlet section 430 and thus the spacing between the positive ion inlet 408 and the negative ion inlet 412 can be reduced. Alternatively, the cross-sections of the electrodes may be truncated in some other suitable manner to achieve the same purpose.

Figure 5:
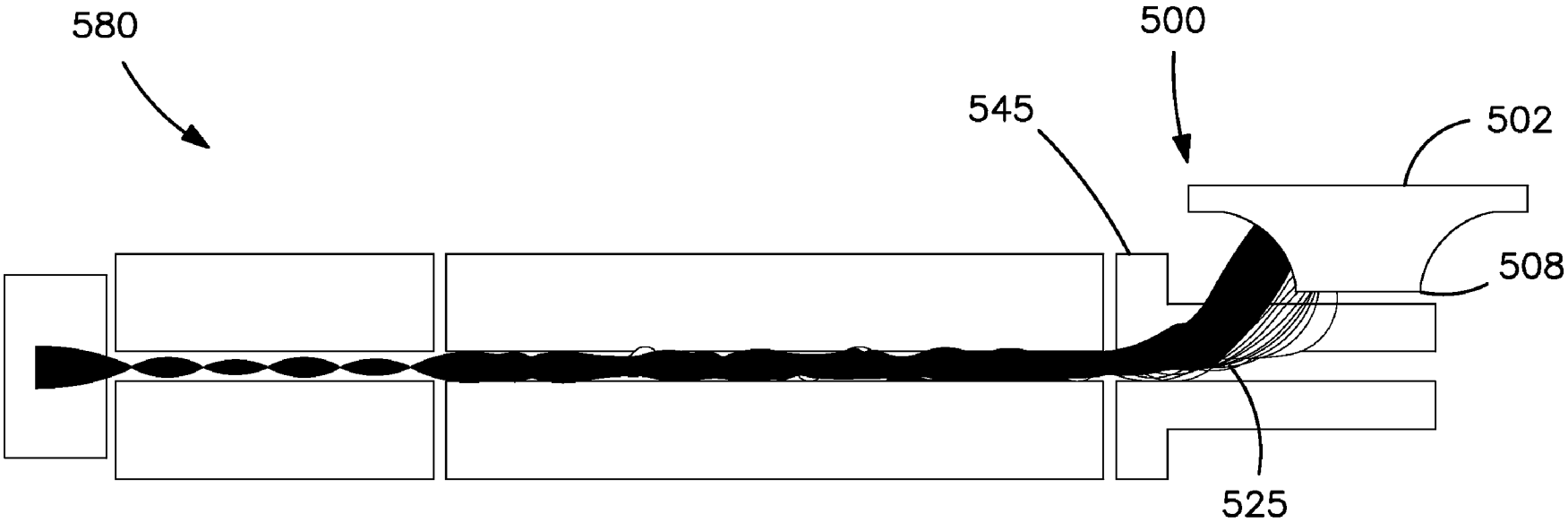
FIG. 5 is a cross-sectional elevation view of an ion processing system illustrating a simulated ion trajectory.

FIG. 5 is a cross-sectional elevation view of an ion processing system 580 that includes an ion detector 500. The ion detector 500 includes a detector ion guide 545 with an electrode set and an offset ion detection device 502 for detecting positive or negative ions as described above. The ion detection device 502 includes an ion inlet 508 arranged about an axis orthogonal to or at some other angle to the longitudinal axis of the electrode set of the detector ion guide 545, as also described above. Another offset ion detection device (not shown) may also be provided for detecting ions of opposite polarity as described above. FIG. 5 further illustrates an ion trajectory or flow path 525 through the ion processing system 500. The ion trajectory 525 was calculated by the software tool SIMION™ developed at the Idaho National Engineering and Environmental Laboratory, Idaho Falls, Id. In this example, the ion trajectory 525 was calculated for low-mass ions (18 amu) at certain non-optimal operating conditions of the ion detector 500 (e.g., the parameters of the RF voltage applied to the electrode set, the bias voltage applied to the ion detection device 502, etc.). As illustrated, the majority of the ions is deflected too early and strike the inactive part of the ion detection device 502, and therefore are not collected for detection. This problem may occur when the high-voltage bias field from the side of the ion detection device 502 penetrates between the electrodes of the detector ion guide 545 and deflects the ions. The problem may be ameliorated somewhat by applying a higher RF voltage to the electrodes, but less than 100% detection may still result.

Figure 6:
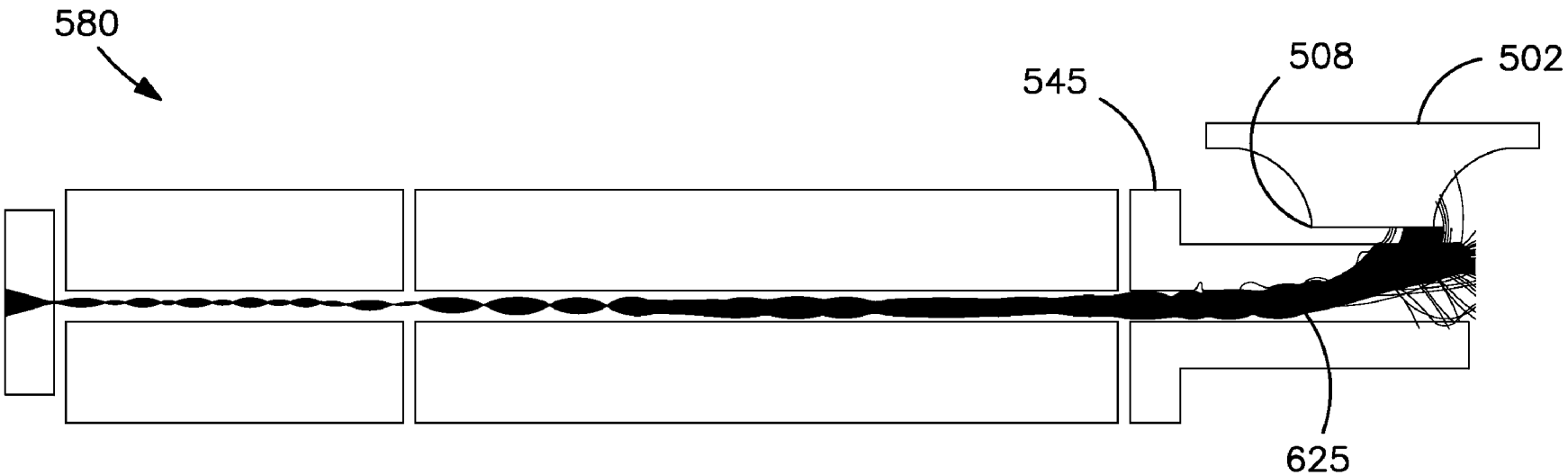
FIG. 6 is a cross-sectional elevation view of an ion processing system illustrating another simulated ion trajectory.

FIG. 6 is a cross-sectional elevation view of the same ion processing system 500. In this example, the ion trajectory 625 was calculated for high-mass ions (1036 amu). As illustrated, the majority of the ions are not deflected enough to reach the ion detection device 502 and therefore are not collected for detection. This problem may occur when the RF voltage applied to the electrodes is so high that the RF voltage in effect annihilates the effect of the high-voltage field penetration of the ion detection device 502.

Figure 7:
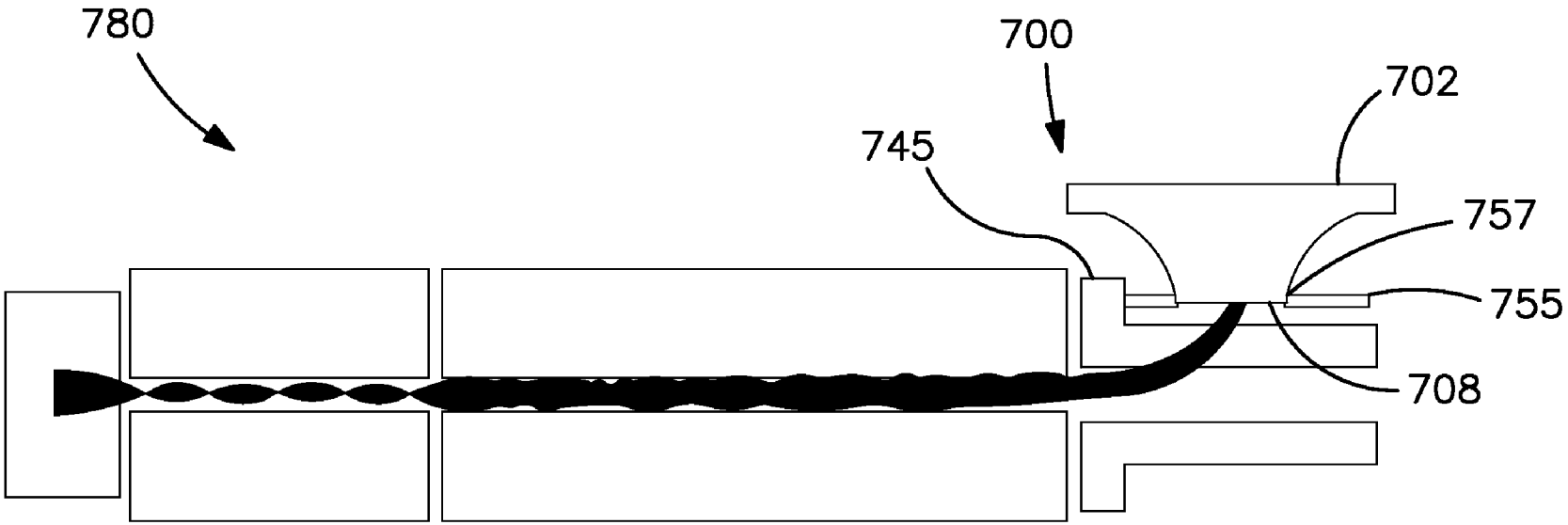
FIG. 7 is cross-sectional elevation view of an example of an ion processing system that provides an ion shield, and illustrating another simulated ion trajectory.

FIG. 7 is a cross-sectional elevation view of an example of an ion processing system 700 that addresses the problem described above associated with the detection of low-mass ions. In this implementation, an electrically conductive ion shield 755 is positioned generally between the electrodes of the detection ion guide 745 and the ion inlet 708 of the offset ion detection device 702. Although not specifically shown, another offset ion detection device may be provided to detect ions of opposite polarity as described above, in which case another shield may be positioned generally between the electrodes and the ion inlet of this second ion detection device. The shield 755 may be positioned, and may have any suitable shape or configuration, so as to shield ions from impinging on the inactive portions of the ion detection device 702. For this purpose in the illustrated example, the shield 755 is plate-shaped and has an opening 757 generally surrounding the ion inlet 708 of the ion detection device 702. The opening 757 may be arranged concentrically with the ion inlet 708 and about the second axis. FIG. 7 also illustrates a simulated ion trajectory 725 for ions having a mass of 18 amu, with the ion path passing through the opening 757 of the shield 755 and into the ion detection device 702. In comparison with FIG. 6, it can be seen that when the shield 755 is provided, low-mass ions, in response to the bias voltage applied to the ion detection device 702, are tightly focused on the center of the ion inlet 708 of the ion detection device 702 and thereby greatly improve detection efficiency.

Figure 8:
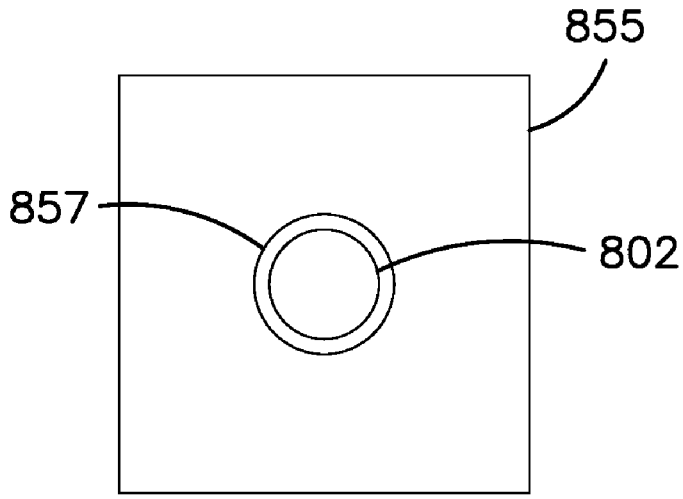
FIG. 8 is a bottom plan view of an example of an ion shield and an ion detection device.
Figure 9:
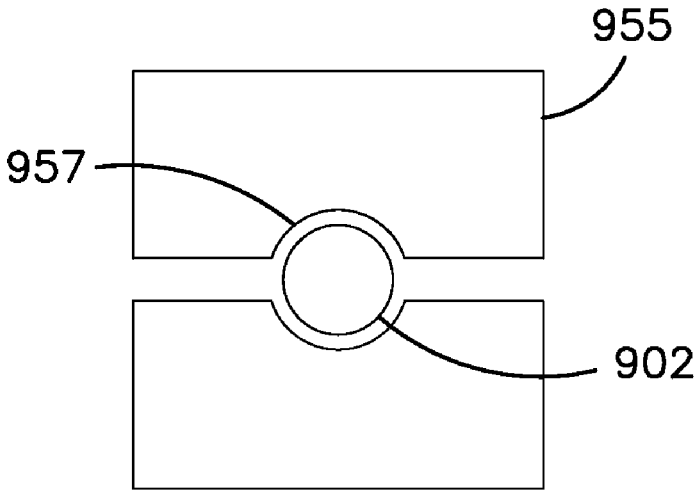
FIG. 9 is a bottom plan view of another example of an ion shield and an ion detection device.

FIG. 8, as an example, is a bottom plan view of a shield 855 looking toward the ion inlet of an ion detection device 802 from the perspective of the electrodes of the detector ion guide. The shield 855 may have a single-piece construction with an opening 857 having a fully closed-boundary geometry completely surrounding the ion inlet. Alternatively, as illustrated in FIG. 9, the shield 955 may be a multi-piece construction with small gaps between the parts of the shield 955 and between the edges or boundaries defining the opening 957 that surrounds the ion inlet of the ion detection device 902. As a further alternative, a conductive shield such as the shield 855 or 955 may not need to completely surround the ion inlet of the ion detection device 802 or 902. For instance, it may be sufficient that the shield cover the area that is generally axially between the ion inlet and the mass filter (or other ion processing device upstream of the ion detector) to prevent early-deflected ions from striking the inactive part of the ion detection device outside of the ion inlet.

Figure 10:
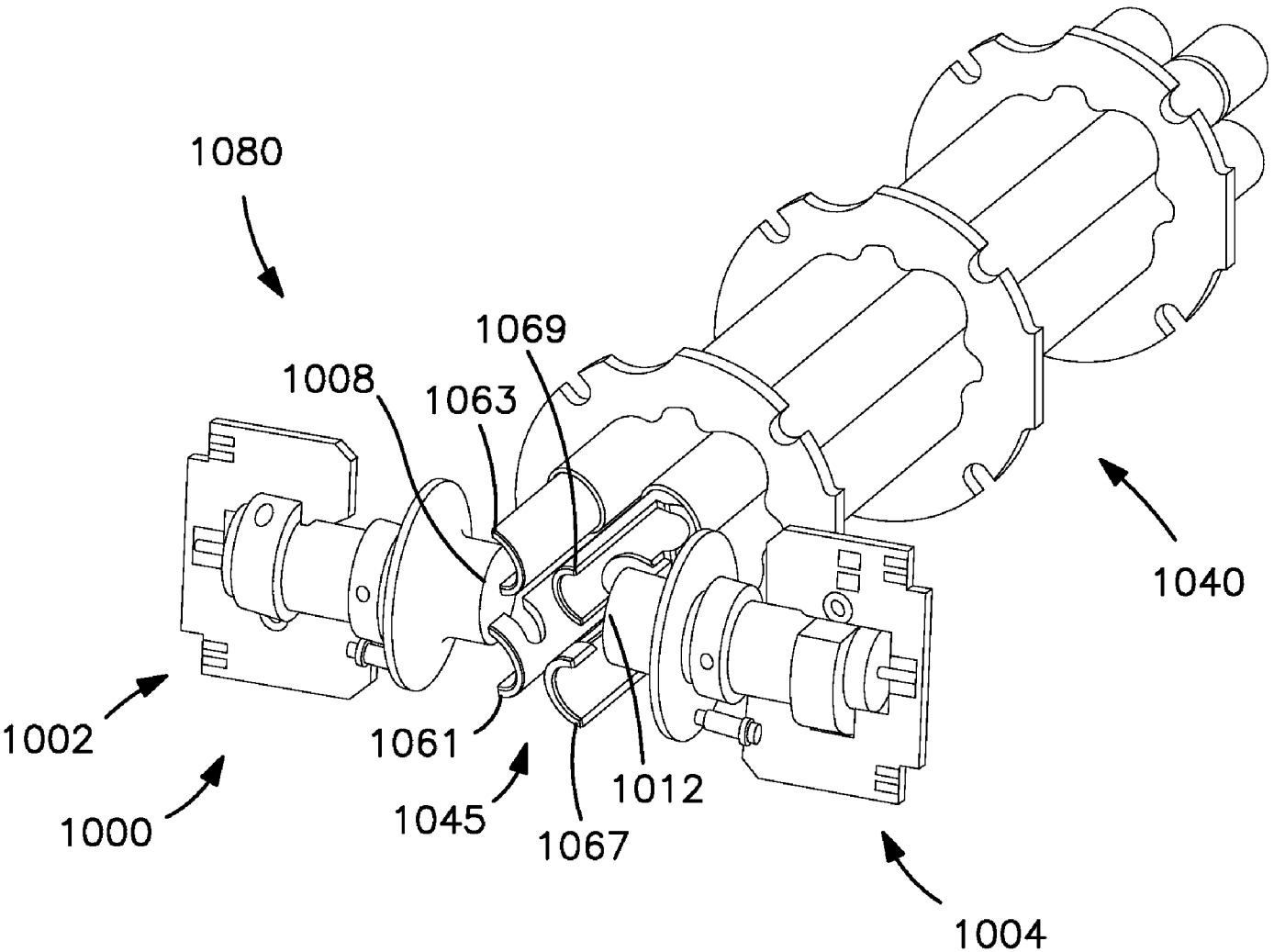
FIG. 10 is a perspective view of another example of an ion detector including a detector ion guide that provides electrode holes and ion shields.
Figure 11:
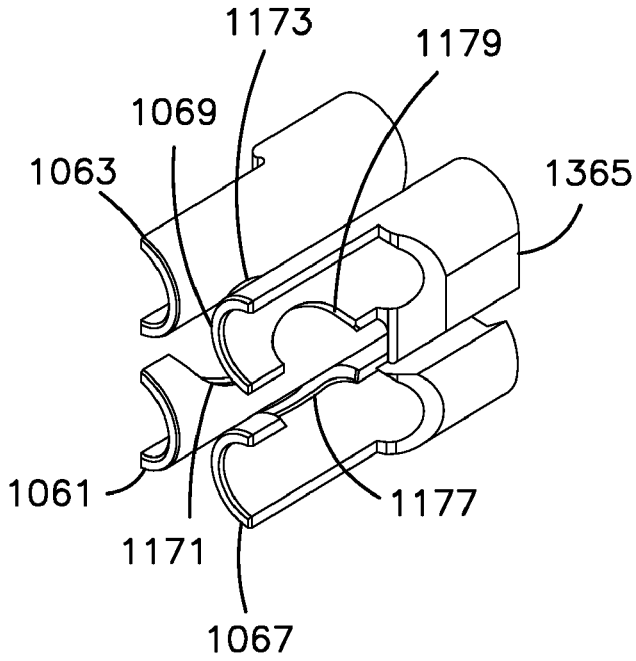
FIG. 11 is a perspective view of the electrode set of the detector ion guide illustrated in FIG. 10.
Figure 12:
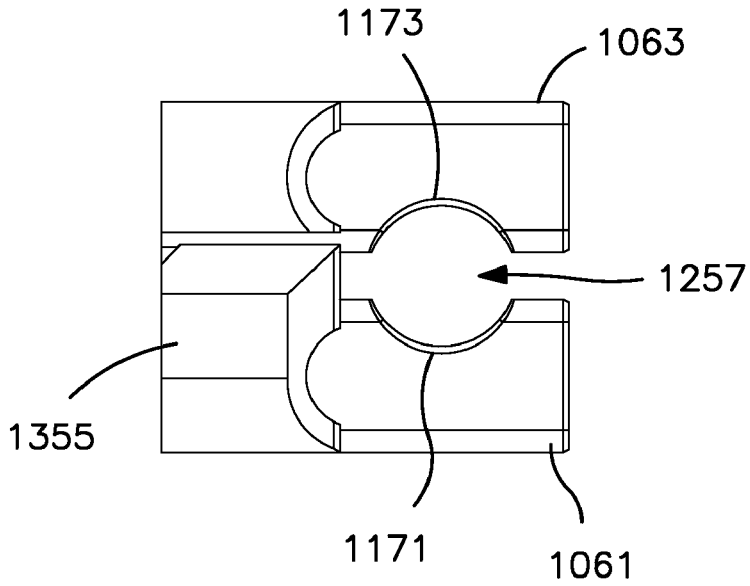
FIG. 12 is a plan view of a pair of electrodes of the electrode set illustrated in FIG. 11 that provides an electrode hole and an ion shield.

FIG. 10 is a perspective view of an example of an ion processing system 1080 that addresses the problem described above associated with the detection of high-mass ions. The ion processing system 1080 may include one or more upstream ion processing devices 1040 and an ion detector 1000 as described above. The ion detector 1000 may include a detector ion guide 1045 and one or more off-set ion detection devices 1002 and 1004 as described above. In this implementation, the electrode set of the detector ion guide 1045 includes a pair of electrodes 1061 and 1063 spaced apart from each other and located proximate to one ion detection device 1002, and another pair of electrodes 1067 and 1069 spaced apart from each other and from the first pair of electrodes 1061 and 1063. If a second ion detection device 1004 is provided as illustrated in this example, the second pair of electrodes 1067 and 1069 is located proximate to the second ion detection device 1004, similar to the configuration illustrated in FIG. 4. As best shown in FIG. 11, each electrode 1061, 1063, 1067, 1069 has a respective cut-out section 1171, 1173, 1177, 1179. For the first pair of electrodes 1061 and 1063, the respective cut-out sections 1171 and 1173 face each other and are oppositely disposed relative to the axis of the ion detection device 1002. For the second pair of electrodes 1067 and 1069, the respective cut-out sections 1177 and 1179 face each other and are oppositely disposed relative to the axis of the other ion detection device 1004 if provided. Accordingly, each corresponding pair of cut-out sections 1171, 1173 and 1177, 1179 is aligned about the axis of the ion detection device(s) 1002 and 1004 and thus is aligned with the ion inlet(s) 1008 and 1012. By this configuration, each pair of cut-out sections 1171, 1173 and 1177, 1179 forms a respective electrode hole 1257 of the electrode set as best shown in FIG. 12, which is a bottom plan of one pair of electrodes 1061 and 1063 looking toward the electrode set from the perspective of the ion inlet 1008 of the ion detection device 1002.

Figure 13:
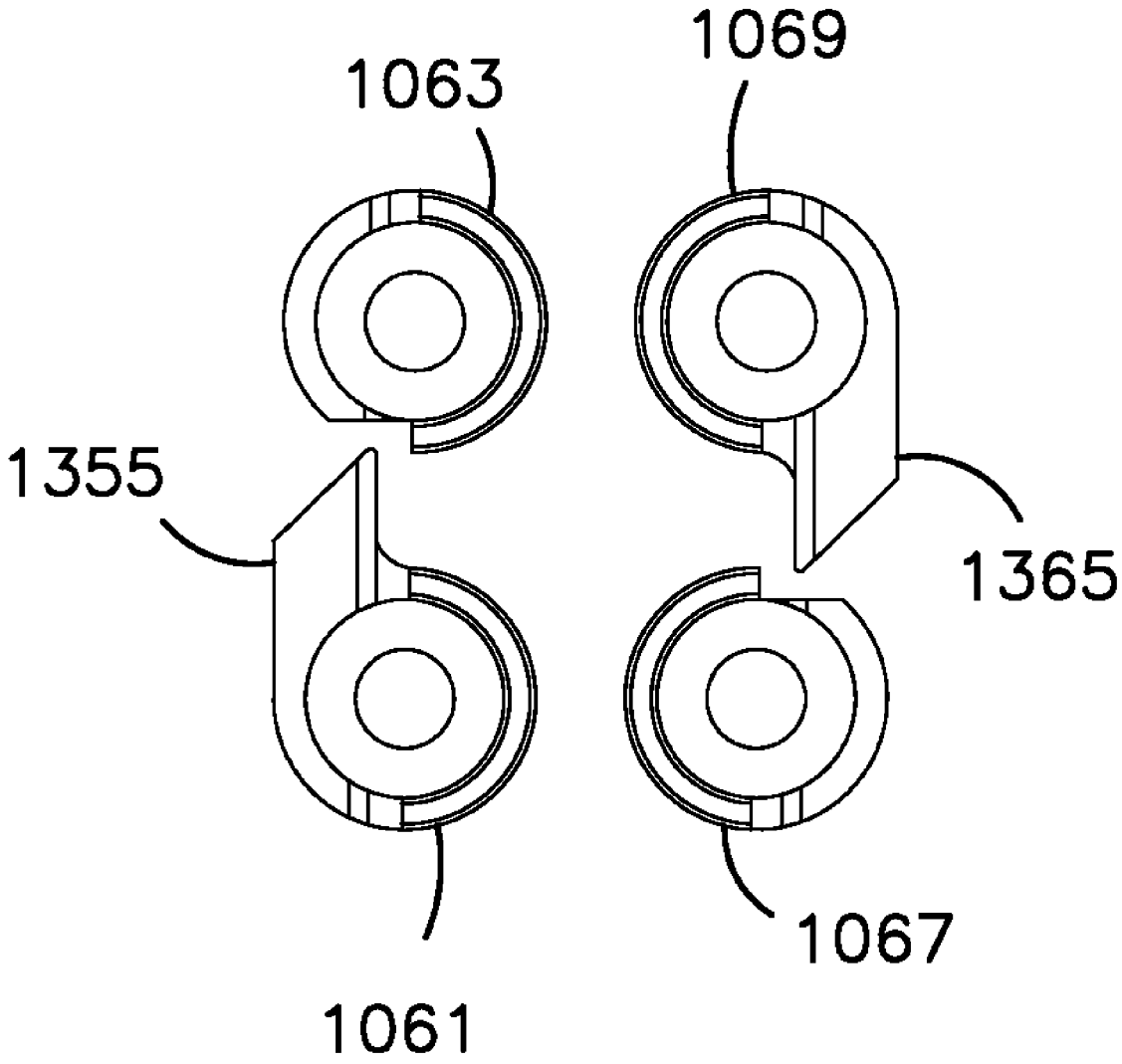
FIG. 13 is an end view of the electrode set illustrated in FIG. 11.

Referring again to FIGS. 11 and 12 and additionally to the end view of the electrode set illustrated in FIG. 13, in this implementation conductive ion shields 1355 and 1365 may be provided as structures integrated with the electrode set. In the illustrated example, the shield 1355 extends from the electrode 1061 generally toward the electrode 1063 and spans the space between this pair of electrodes 1061 and 1063. Likewise, the shield 1365 extends from the electrode 1069 generally toward the electrode 1067 and spans the space between this pair of electrodes 1067 and 1069. In the specifically illustrated example, the shields 1355 and 1365 cover the spaces upstream of the electrode holes 1257 (FIG. 12) and corresponding ion inlets. However, in other implementations additional shield structures may be provided on other sides of the electrode holes or may completely surround the electrode holes, similar to the examples illustrated in FIGS. 7-9. The shields 1355 and 1365 do not adversely affect the two-dimensional RF field applied by the electrode set, and may reduce RF field faults.

Figure 14:
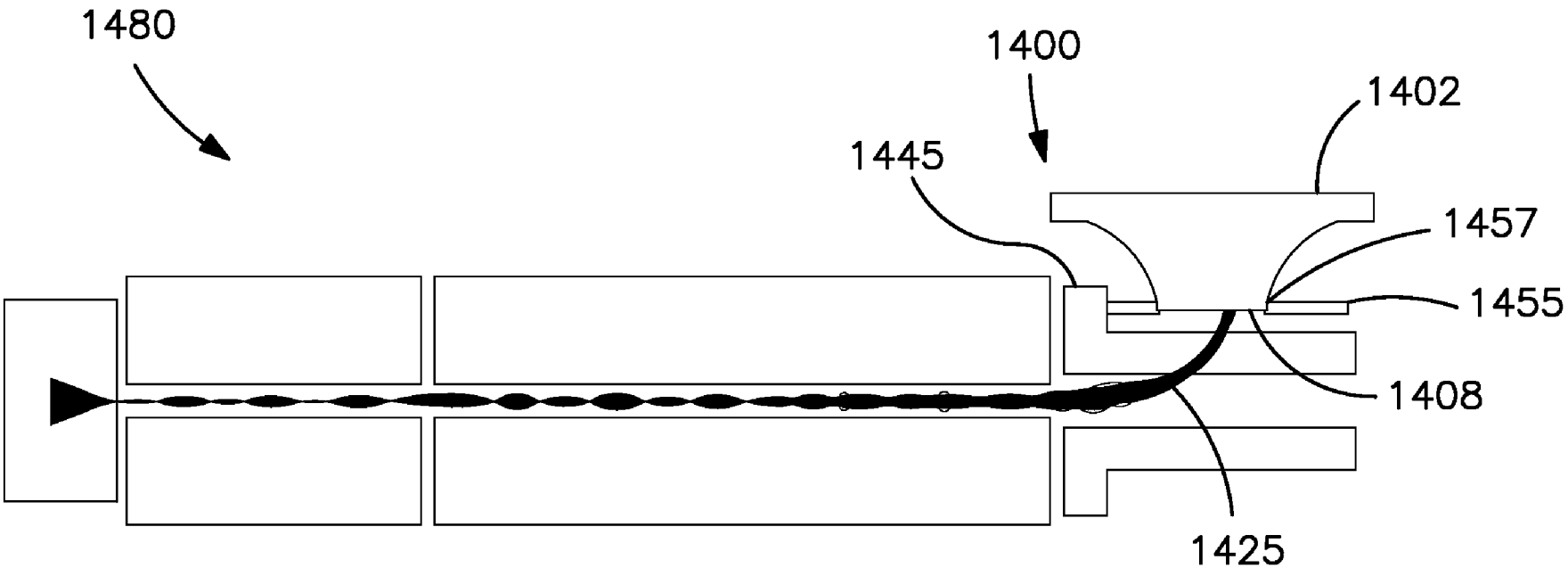
FIG. 14 is a cross-sectional elevation view of an example of an ion processing system that provides an ion shield and an electrode hole, and illustrating another simulated ion trajectory.

FIG. 14 is a cross-sectional elevation view of the ion processing system 1480 similar to that illustrated in FIG. 10. FIG. 14 illustrates a simulated ion trajectory 1425 for ions having a mass of 3000 amu, with the ion path passing through the electrode hole defined by the cut-outs (FIGS. 10-12) of the pair of electrodes proximal to the detector ion guide 1445 and into the corresponding ion detection device 1402. In comparison with FIG. 7, it can be seen that when the electrode hole is provided, high-mass ions, in response to the bias voltage applied to the ion detection device 1402, are tightly focused on the center of the ion inlet 1408 of the ion detection device 1402 and thereby greatly improve detection efficiency. The electrode hole greatly increases the penetration of the electrical field established by the bias voltage applied to the ion detection device 1002. FIG. 14 also illustrates that plate-type shield(s) 1455 may be provided in combination with the electrode hole(s), in which case the deflected ions pass through an opening 1457 of the shield 1455 as well as the electrode hole. That is, the deflected ions pass around or adjacently to the structure of the shield 1455. Alternatively, shields that are integrated with the electrodes as shown in FIGS. 11-13 may be provided. Ion simulations have demonstrated that the off-axis detectors taught in the present disclosure work well for ions in the mass range of 10-3000 amu. It is believed that these off-axis detectors will also work well for even higher ion masses.

It will be understood that the methods and apparatus described in the present disclosure may be implemented in an ion processing system such as an MS system as generally described above by way of example. The present subject matter, however, is not limited to the specific ion processing systems illustrated herein or to the specific arrangement of circuitry and components illustrated herein. Moreover, the present subject matter is not limited to MS-based applications, as previously noted.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion detector for selectively detecting positive and negative ions, the ion detector comprising:

an ion guide including a plurality of electrodes arranged about a first axis and configured to apply an RF field to constrain ions to motions generally about the first axis;

a positive ion detection device including a positive ion inlet disposed at a first side of an ion output section, the positive ion inlet being offset from and at an angle to the first axis, the positive ion detection device configured to apply a negative voltage bias and accelerate positive ions along a positive ion path directed from the ion guide into the positive ion inlet, the positive ion path including a component directed along a second axis orthogonal to the first axis; and a negative ion detection device including a negative ion inlet disposed at a second side of the ion output section opposite the first side, the negative ion inlet being offset from and at an angle to the first axis, the negative ion detection device configured to apply a positive voltage bias and accelerate negative ions along a negative ion path directed from the ion guide into the negative ion inlet, the negative ion path including a component directed along the second axis generally opposite to the component of the positive ion path.

2. The ion detector of claim 1, wherein the positive ion inlet and the negative ion inlet are arranged about the second axis.

3. The ion detector of claim 1, further including an RF voltage generator communicating with at least one of the plurality of electrodes.

4. The ion detector of claim 1, wherein each electrode has a semi-circular cross-section.

5. The ion detector of claim 1, further including means for switching the ion detector between a detecting mode and a non-detecting mode, wherein in the detecting mode the negative voltage bias and the positive voltage bias are ON, and in the non-detecting mode the negative voltage bias and the positive voltage bias are OFF and ions constrained by the ion guide are transported along the first axis to an exit of the ion guide.

6. The ion detector of claim 5, wherein the switching means includes a negative voltage bias source communicating with the positive ion inlet and a positive voltage bias source communicating with the negative ion inlet.

7. The ion detector of claim 1, further including an upstream ion processing device communicating with the ion guide, the upstream ion processing device selected from the group consisting of an ionizing device, an ion storage device, a mass-analyzing device, an ion fragmenting device, and combinations of two of more of the foregoing, and further including downstream ion processing device communicating with the ion guide, the downstream ion processing device selected from the group consisting of an ion storage device, a mass-analyzing device, an ion fragmenting device, a particle collection device, and combinations of two of more of the foregoing.

8. The ion detector of claim 1, further including an electrically conductive first shield disposed between a first electrode pair of the plurality of electrodes, and an electrically conductive second shield disposed between a second electrode pair of the plurality of electrodes, wherein the positive ion path passes adjacently to the first shield and the negative ion path passes adjacently to the second shield.

9. The ion detector of claim 1, further including an electrically conductive first shield plate disposed between the plurality of electrodes and the positive ion detection device and an electrically conductive second shield plate disposed between the plurality of electrodes and the negative ion detection device, the first shield plate having a first opening surrounding the positive ion inlet and the second shield plate having a second opening surrounding the negative ion inlet, wherein the positive ion path passes through the first opening and the negative ion path passes through the second opening.

10. The ion detector of claim 1, wherein the plurality of electrodes includes a first pair of electrodes spaced from each other and disposed proximate to the positive ion inlet and a second pair of electrodes spaced from each other and disposed proximate to the negative ion inlet, the first pair of electrodes have respective cut-out sections facing each other to define a first electrode hole arranged about the second axis, the second pair of electrodes have respective cut-out sections facing each other to define a second electrode hole arranged about the second axis, the positive ion path passes through the first electrode hole and the negative ion path passes through the second electrode hole.

11. The ion detector of claim 1, further including an upstream ion processing device including a plurality of upstream electrodes respectively transitioning into the plurality of electrodes of the ion guide, each upstream electrode and each electrode of the ion guide having a cross-sectional area in a plane orthogonal to the first axis, wherein the cross-sectional area of each electrode of the ion guide is less than the cross-sectional area of the corresponding upstream electrode.

12. A method for selectively detecting positive and negative ions, the method comprising:

guiding a plurality of particles in an ion guide generally along a first axis by applying an RF voltage to a plurality of electrodes of the ion guide to generate an RF field in the ion guide and constrain ions of the plurality of particles to motions focused along the first axis;

negatively biasing a first ion detector and accelerating any positive ions of the plurality of particles to flow along a positive ion path from the ion guide toward the first ion detector, the positive ion path including a component directed along a second axis orthogonal to the first axis; and positively biasing a second ion detector and accelerating any negative ions of the plurality of particles to flow along a negative ion path from the ion guide into the second ion detector, the negative ion path including a component directed along the second axis generally opposite to the component of the positive ion path.

13. The method of claim 12, further including switching between a detecting mode and a non-detecting mode, wherein in the detecting mode the first ion detector is negatively biased and the second ion detector is positively biased, and in the non-detecting mode the negative biasing and the positive biasing are not utilized and ions focused by the applied RF field pass through the ion guide to an exit of the ion guide without being detected.

14. The method of claim 12, wherein guiding includes guiding both positive ions and negative ions, and further including operating the first ion detector and the second ion detector to respectively detect positive and negative ions substantially simultaneously.

15. The method of claim 12, wherein guiding includes guiding a first group of particles followed by guiding a second group of particles, and further including operating one of the first and second ion detectors to detect ions of the first group having one polarity and, sequentially, operating the other ion detector to detect ions of the second group having the opposite polarity.

16. The method of claim 12, wherein guiding includes guiding neutral particles, and further including flowing the neutral particles generally along the first axis, through the ion guide between the first ion detector and the second ion detector, and to an exit of the ion guide.

17. The method of claim 12, further including operating one of the first and second ion detectors to detect ions having a polarity detectable by the operated ion detector, and flowing any ions having an opposite polarity and any neutral particles generally along the first axis, through the ion guide between the first ion detector and the second ion detector, and to an exit of the ion guide.

18. The method of claim 12, including flowing ions through an electrode hole arranged about the second axis and into the first or second ion detector, the electrode hole formed by respective cut-out sections of a pair of the plurality of electrodes.

19. The method of claim 12, further including processing a plurality of ions, wherein processing is selected from the group consisting of ionizing a material to produce the plurality of ions, storing the plurality of ions in an RF trapping field, mass-sorting the plurality of ions, fragmenting ions to produce the plurality of ions, and combinations of two of more of the foregoing, and wherein guiding includes guiding at least some of the processed ions into the ion guide.

20. The method of claim 12, further including flowing at least some of the plurality of particles to exit through the ion guide between the first ion detector and the second ion detector, and processing the exited plurality of particles, wherein processing is selected from the group consisting of storing ions of the plurality of particles in an RF trapping field, mass-sorting ions of the plurality of particles, fragmenting ions of the plurality of particles, collecting at least some of the plurality of particles, and combinations of two of more of the foregoing.

* * * * *